United States Patent [19]

Evans

[11] Patent Number: 4,724,637

[45] Date of Patent: Feb. 16, 1988

[54] TWO SIDED VERTICAL BUTT GLAZE SYSTEM FOR WINDOW STRUCTURES

[75] Inventor: Lyon D. Evans, Wausau, Wis.

[73] Assignee: Enwall, Inc., Frazer, Pa.

[21] Appl. No.: 864,664

[22] Filed: May 19, 1986

[51] Int. Cl.[4] ..... E04B 1/62

[52] U.S. Cl. ..... 52/209; 52/204; 52/206; 52/235; 52/393; 52/397; 52/766; 52/775; 52/741; 52/213

[58] Field of Search ..... 52/209, 213, 464, 235, 397, 52/398, 204, 200, 207, 206, 770, 776, 775, 773, 393; 49/401, 504

[56] References Cited

U.S. PATENT DOCUMENTS

| | | | |
|---|---|---|---|
| 2,791,004 | 5/1957 | Sullivan | 52/213 |
| 3,001,245 | 9/1961 | Gillett | 52/209 |
| 3,160,243 | 12/1964 | Kelly | 52/213 |
| 3,196,998 | 7/1965 | Owen . | |
| 3,316,681 | 5/1967 | Eber | 52/235 |
| 3,381,434 | 5/1968 | Carson | 52/397 |
| 3,579,939 | 5/1971 | Eichman | 52/397 |
| 3,678,625 | 7/1972 | Vance | 52/207 |
| 3,691,713 | 9/1972 | Dulaney | 52/397 |
| 3,769,775 | 11/1973 | Brzezinsi | 52/731 |
| 3,866,369 | 2/1975 | Paull | 52/209 |
| 3,919,815 | 11/1975 | Alabaster | 52/209 |
| 4,021,987 | 5/1977 | Schnebel | 52/235 |
| 4,134,238 | 1/1979 | Auger | 52/127 |
| 4,187,657 | 2/1980 | Sukolics | 52/397 |
| 4,387,542 | 6/1983 | Wehr | 52/209 |
| 4,453,355 | 6/1984 | Stoakes | 52/235 |
| 4,464,879 | 8/1984 | Shea | 52/398 |
| 4,471,584 | 9/1984 | Dietrich | 52/235 |
| 4,525,966 | 7/1985 | Litchfield et al. | 52/397 |
| 4,581,852 | 4/1986 | Jager | 49/401 |

FOREIGN PATENT DOCUMENTS

| | | | |
|---|---|---|---|
| 885224 | 11/1971 | Canada | 52/398 |
| 2013245 | 11/1970 | Fed. Rep. of Germany | 49/401 |
| 2263990 | 7/1973 | Fed. Rep. of Germany . | |

*Primary Examiner*—John E. Murtagh

*Attorney, Agent, or Firm*—Seidel, Gonda, Goldhammer & Abbott

[57] ABSTRACT

A "dry" two sided vertical structural butt glaze system for window structures wherein a modular frame assembly is fabricated and glazed off-site. The assembly is installed in the window structure from the building interior and is provided with gasket strips which seal the exterior butt joint between adjacent panels of the frame assemblies. Exterior scaffolding and caulking operations are eliminated.

25 Claims, 5 Drawing Figures

TWO SIDED VERTICAL BUTT GLAZE SYSTEM FOR WINDOW STRUCTURES

BACKGROUND OF THE INVENTION

Modern skyscrapers often have continuous horizontal window areas extending around the building exterior. These areas are filled by glass panels which are arranged side-by-side with only a vertical caulked joint separation. The panels are structurally bonded to interior vertical window framing members only and thus no vertical framing members are visible on the exterior side, only the caulked joint. The panels are installed, glazed and caulked by workers operating on scaffolding along the building exterior.

A typical installation technique is as follows. A continuous frame head member which is a channel-shaped aluminum extrusion having an inverted U-shaped section is secured to the upper portion of the building window structure. A continuous frame sill member which is a channel-shaped aluminum extrusion having a U-shaped section is secured to the lower portion of the window structure. The frame head and sill are a permanent part of the window structure. Vertical impost framing members which are usually rectangular hollow aluminum extrusions are secured to the frame head and sill members, running vertically and spaced to accommodate required panel widths. The glass panel is then installed on-site from the building exterior, being tilted in at the top and then dropped down so that the bottom end portion of the glass panel locates in the frame sill channel, the upper end portion of the glass panel locates in the frame head channel and the vertical joint between the panels occurs in front of and overlaps the secured vertical imposts. Neoprene strips having a wedge-shaped section are forced between the rear of the glass panel and the frame head and sill members so as to urge the glass panel against the horizontal gasket strips secured to the frame head and sill thereby sealing the glass panel horizontal perimeters. Multiple glass panels are arranged side-by-side and secured and sealed between the frame head and sill in this manner, overlapping the imposts.

The exterior vertical butt joints between adjacent glass panels and the interior structural joints between the glass and imposts must then be sealed. The latter is done on-site by inserting a silicone compatible spacer gasket between the interior glass surface and impost finished off on top with a bead of gun-grade structural silicone on each glass edge. The glass panels must then be clamped from the exterior to the imposts while the structural silicone beads cure. This may take as long as two weeks. The clamps are then removed and, from the exterior, a back-up rod is inserted at the exterior butt joints between panels followed by an overlay bead of silicone culking to seal the joint.

In the system described, the outer legs or apron portions of the frame head and frame sill which overlap and secure the glass are visible from the building exterior. The exterior vertical joints between panels however are merely caulked; thus no aluminum members are visible. This is known as a two sided vertical butt glaze system. Conventional "wet" installation of a two sided butt glaze system requires glazing on-site, usually totally from the building exterior, with a substantial lapse in time between glazing and final caulking of the exterior butt joints. In addition, the replacement of a broken panel requires the remnants of the panel to be separate from the mullions with subsequent re-glazing and re-caulking operations as previously described. Replacement, like installation, is therefore labor intensive and extremely costly.

The present invention is directed to rapidly installing a fully factory glazed two sided vertical butt glaze system from the building interior such that the vertical exterior glass panel butt joints are sealed during such installation and such that the glass panels can be replaced with minimal labor and expensive should it ever become necessary.

BRIEF SUMMARY OF THE INVENTION

System for two sided vertical butt type installation of glass and/or other panels in a building structure comprising a continuous head liner and sill liner respectively secured to upper and lower portions of the building structure, a modular factory glazed and assembled frame assembly insertable as a unit between the head and sill liners and slideable therebetween, and means for securing and aligning the modular frame assembly in position between the head and sill liners. The modular frame assembly includes a frame head and frame sill extending in parallel, a first mullion section and a second mullion section extending vertically in parallel and secured to opposite ends of the frame head and frame sill, and a glass or other type panel bonded along its entire perimeter to the frame head, the frame sill and the first and second mullion sections. The first and second mullion sections are provided with mating structure such that the first mullion section of one modular frame assembly slidingly interlocks with a second mullion section of another modular frame assembly. The first and second mullion sections are also provided with recesses to accommodate complementary silicone compatible gaskets so as to seal the exterior butt joints between the glass panels of adjacent modular frame assemblies when installed. A continuous wedge, of aluminum (or other suitable material) at the sill and a clamp at the head is driven between the completed modular frame assembly and the liners to lock and thus position and secure the frame with the required pressure of the glass panels against the exterior head and sill liner gaskets.

DETAILED DESCRIPTION OF INVENTION

Figure 1:
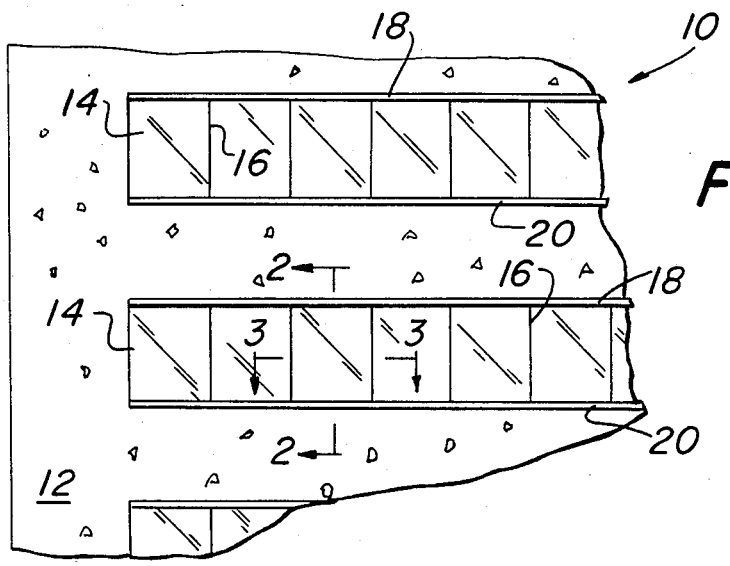
FIG. 1 is an elevation of a building structure showing the butt glaze system of the present invention as installed.

Referring to the drawings wherein like numerals indicate like elements there is shown in FIG. 1 an elevaion of a building structure showing the two sided butt glaze system of the present invention designated generally as 10. The system is mounted on a building side wall 12 and the glass panels 14 define a series of vertical butt joints 16. The upper and lower edge portions of the panels are concealed by a head liner apron portion 18 and a sill liner apron portion 20. The panels 14 are glazed off-site as described hereinafter. Accordingly, the completed panel frame assemblies can be rapidly installed from the building interior and the vertical butt joints between panels can be sealed, in a single operation. The result is a dramatic reduction in labor, cost of installation, field modification and repair and a better total installation with improved and consistent performance due to the close tolerances and ideal conditions for assembly, cleaning, glazing and bonding realized when done in a factory controlled environment.

Figure 2:
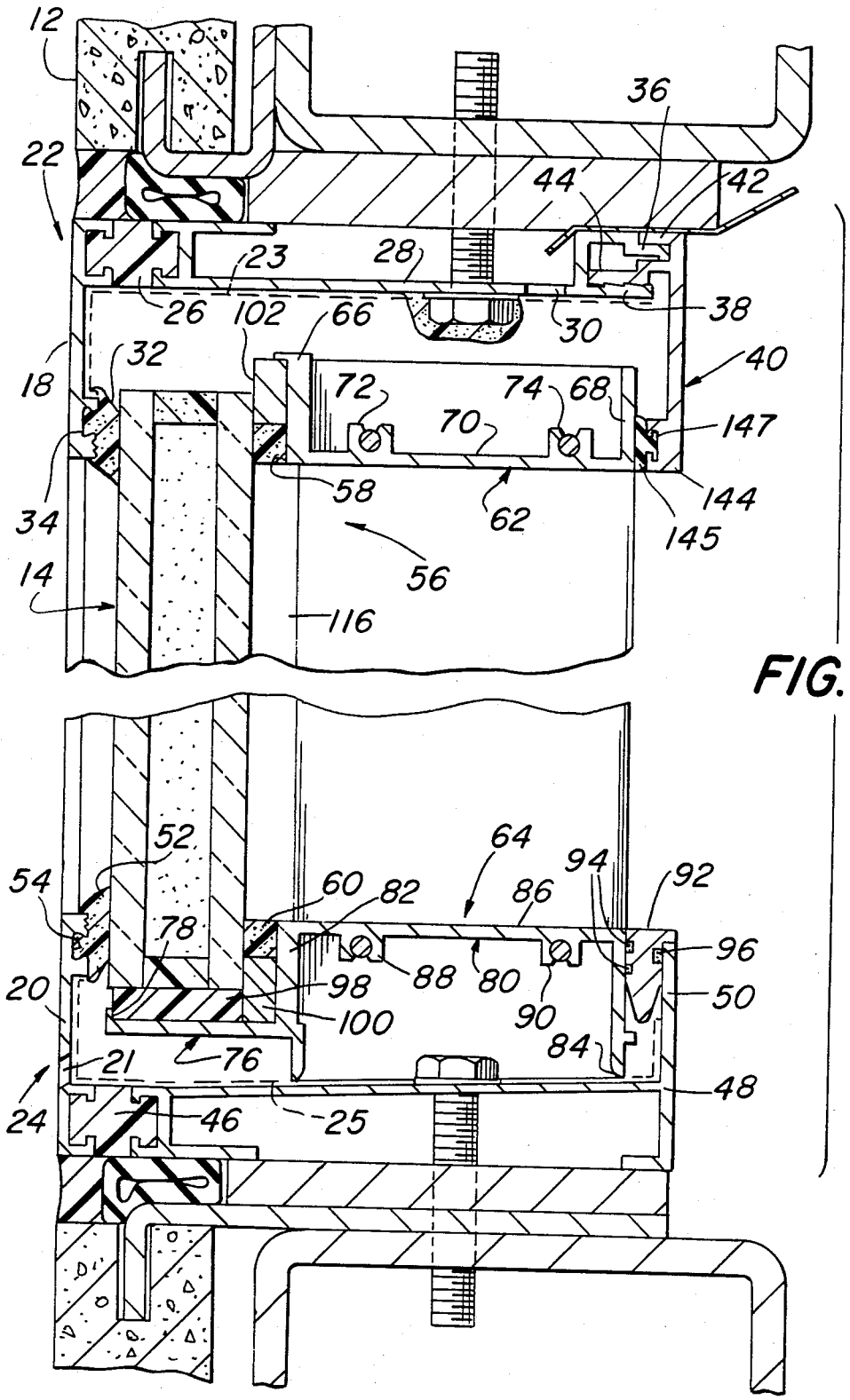
FIG. 2 is a cross-section taken along 2—2 in FIG. 1.

In the present invention, as best shown in FIG. 2, a head liner 22 and sill liner 24 are secured in ten to twenty foot lengths to the upper and lower portions of the building window structure. The liners are preferably aluminum extrusions. Butt type expansion joints between adjacent lengths of liner are backed-up by interior splice plates 23 and 25 and later sealed. Liners 22, 24 therefore form a permanent part of the building construction.

Apron portion 18 of head liner 22 is connected by a filler of plastic or suitable low thermal conductive material 26 to web portion 28 of the head liner. The filler serves as a thermal barrier between the liner portions 18, 28 so as to reduce condensation on and heat flow between the liner portion 28 and locking clamp 40 surfaces. The web portion is provided with a weep hole 30 to provide a water drainage channel as described hereafter. A continuous extruded pressure glazing gasket strip 32 made of sponge neoprene (OR EPDM) is secured in a dovetail groove or socket 34 in apron portion 18. The rear of web portion 28 is provided with a recess defined by an upper pilot flange 36 and a lower toothed flange 38. An extruded locking clamp 40, preferably aluminum, is provided with a pilot flange 42 and a toothed flange 44. Thus, the head liner and locking clamp are provided with mating structure for slidingly interlocking the two together. The lower leg portion 144 of the locking clamp is provided with a dovetail groove or socket 147 within which a continuous extruded gasket weatherstrip 145 made of sponge neoprene (or EPDM) is seated.

Apron portion 20 of sill liner 24 is provided with a weep hole 21 to provide an outlet for the aforementioned water drainage channel. Portion 20 is connected by a filler of plastic or suitable low thermal conductive material 46 to an upward slanted L-shaped portion 48 of the sill liner. The plastic filler serves as a thermal barrier between the liner portions 20, 48 so as to reduce condensation on and heat flow between the liner portion surfaces. The slanted L-shaped liner portion 48 includes an upstanding inner leg portion 50. A continuous extruded pressure glazing gasket strip 52 made of sponge neoprene (or EPDM) is secured in a dovetail groove or socket 54 in apron portion 20.

The modular frame assembly of the present invention is designated as 56 in FIG. 2. The assembly includes glass panel 14 which is bonded by structural silicone sealant beads 58, 60 to a frame head 62 and a frame sill 64. The frame head is a channel shaped aluminum extrusion having a generally U-shaped section defined by an outer leg portion 66, an inner leg portion 68, and a web portion 70 connecting portions 66, 68. Web portion 70 is provided with a pair of screw receptacles 72, 74 for securing the frame head to mullions as described hereafter.

Frame sill 64 is a channel-shaped aluminum extrusion having a shelf portion 76 provided with a lip 78, and a portion 80 having a generally inverted U-shaped section connected to shelf portion 76. Portion 80 includes an outer leg portion 82, an inner leg portion 84, and a web portion 86 connecting leg portions 82, 84. Web portion 86 is provided with a pair of screw receptacles 88, 90 for securing frame sill 64 to mullions as described hereafter.

A continuous extruded aluminum strip 92 having a generally wedge shaped section is frictionally driven between frame sill outer leg portion 84 and sill liner inner leg portion 50. Preferably, strip 92 is provided with grooves 94, 96 which are filled with a sealant composition prior to its insertion between leg portions 84, 50, so as to further secure the seal at the interface of the wedge and frame sill.

Glass panel 14 is spaced from frame sill shelf portion 76 and frame sill leg portion 82 by silicone compatible setting blocks 98, and continuous spacer 100. The panel is also spaced from frame head leg portion 66 by a continuous silicone compatible spacer block 102. Setting blocks 98 are located at the quarter points of panel 14.

Figure 3:
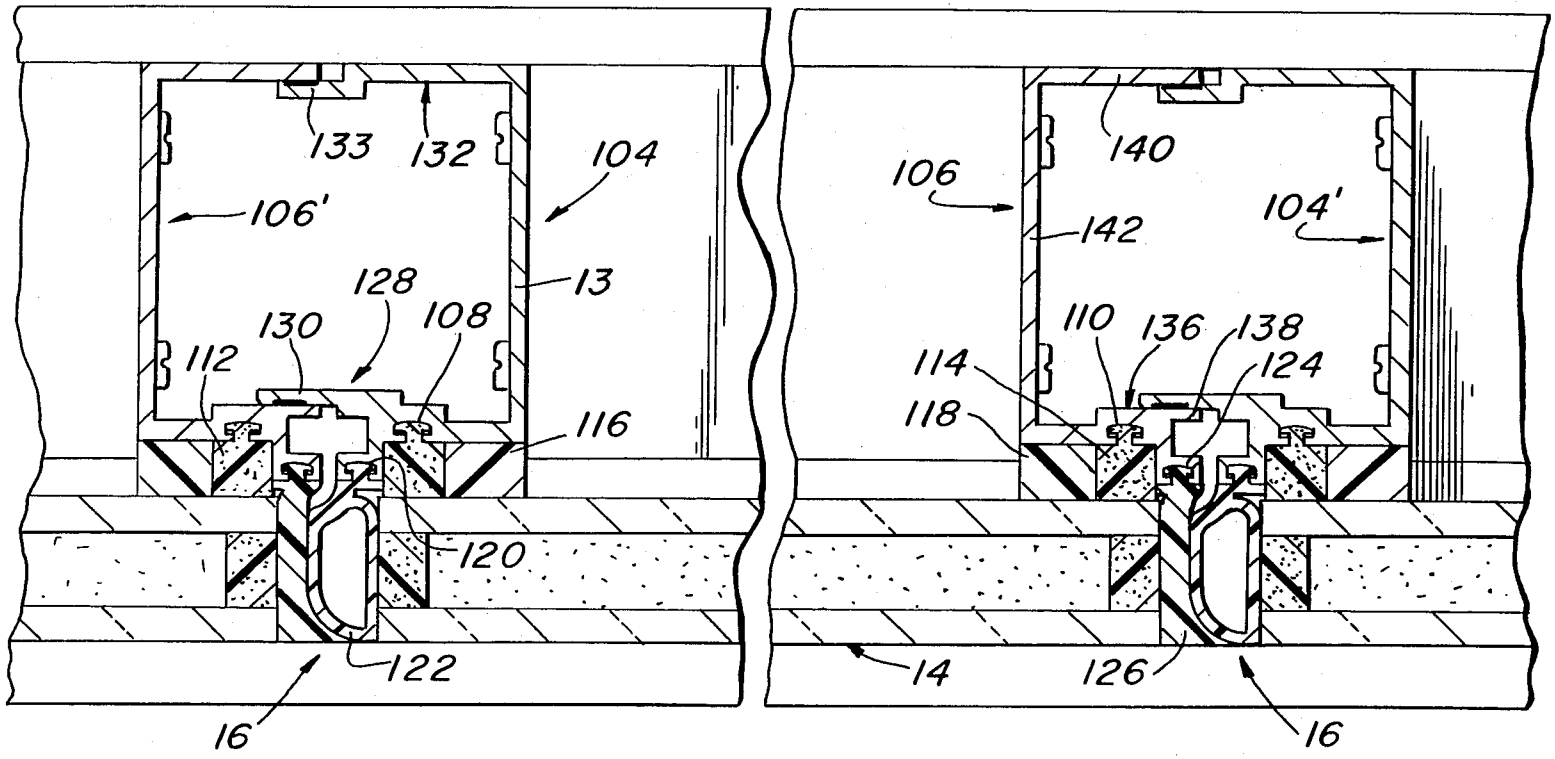
FIG. 3 is a cross-section taken along 3—3 in FIG. 1.

Referring to FIG. 3, each modular frame assembly is provided with a pair of extruded aluminum mullion sections 104, 106. Mullion section 104 is screw fastened to the frame head and frame sill screw receptacles 72, 74, 88, 90 on one side of the modular frame assembly. Mullion section 106 is screw fastened to the same frame head and frame sill screw receptacles on the other side of the modular frame assembly.

Mullion sections 104, 106 are respectively provided with dovetail sockets 108, 110 in which continuous silicone compatible extruded gasket strips 112, 114 are seated. Glass panel 14 is structurally bonded along one side edge portion to mullion section 104 by a structural silicone bead 116 and on an opposite side edge portion to mullion section 106 by structural silicone bead 118. Mullion section 104 is provided with a dovetail groove or socket 120. A continuous deformable bulb type gasket strip 122 made of a low durometer silicone compatible material is anchored in dovetail socket 120 to account for tolerance in building structure and the transverse dimension of panel 14. Mullion section 106 is provided with a dovetail socket 124. A continuous high durometer gasket strip 126 made of a silicone compatible material is anchored in socket 124. Gasket strips 122, 126 are shaped so as to provide a seal at each exterior vertical panel butt joint 16 upon contact with each other as shown in FIG. 3. Each butt joint 16 is thereby sealed without application of any caulking or sealant from the building exterior. Thus, the present invention makes possible installation by a "dry" butt glaze system totally installed from the interior.

Mullion section 104 is a channel-shaped aluminum extrusion having a generally U-shaped section. The mullion section includes an outer leg portion 128 having a flange portion 130 with a recessed portion for sealant application and an inner leg portion 132 having a flange portion 133 with a recessed portion for sealant application. The inner leg portion is connected to the outer leg portion by a web portion 134. Mullion section 106 is a channel-shaped aluminum extrusion having a generally U-shaped section. The mullion section includes an outer leg portion 136 having a flange portion 138 and an inner leg portion 140 connected to the outer leg portion by web portion 142. Mullion section portions 130, 133 and 136, 140 comprise mating structure such that the mullion section 104 (106') of one modular frame assembly slidingly and sealingly interlocks with the mullion section 106 (104') of an adjacent modular frame assembly. This structure also allows for movement of the mullion sections of installed adjacent frames with respect to each other, for example due to thermal expansion and contraction or to building movement, or adjustments required by building tolerances, without damage to the frame assembly components.

Figure 4:
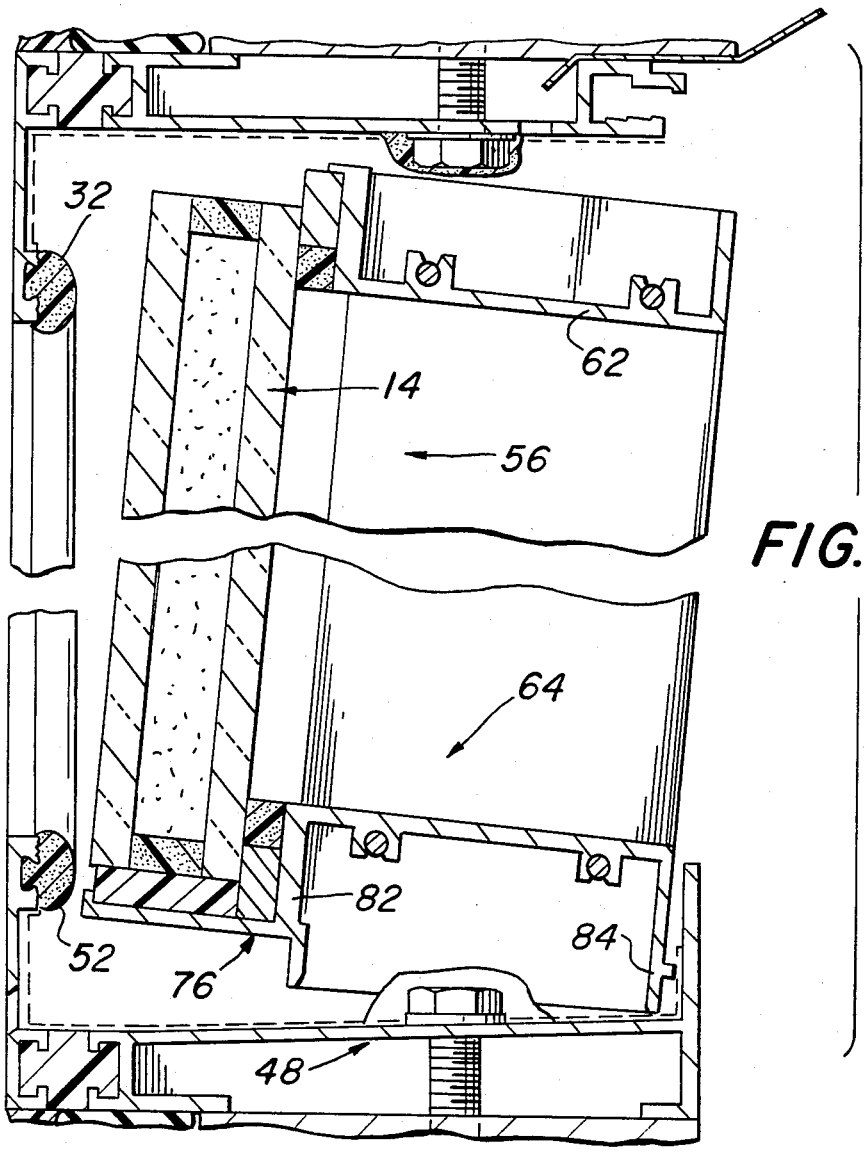
FIG. 4 is a section showing a modular frame assembly being installed from the building interior according to the present invention.

The manner in which a modular frame assembly 56 is installed at the building site is shown in FIG. 4. The top portion of the modular frame assembly is tilted rearwardly, towards the building interior, and the bottom portion of the assembly is inserted in the sill liner 48. The inner leg portion 84 of frame sill 64 rests on the sill liner. The modular frame assembly is then pivoted on leg portion 84, the top portion of the modular frame assembly then being tilted forwardly, towards the building exterior, so that the panel 14 comes to an upright position contacting both glazing gasket strips 32, 52. With panel 14 in the upright position, inner leg portion 82 rests on the sill liner as shown in FIG. 2. Frame head 62 clears head liner 22 such that vertical deflection of the head liner due to mechanical loading experienced by the building structure, for example live and dead loads, settling, creep and the like, does not transmit the load to the modular frame assembly. Accordingly, the glass panel 14 does not experience any compressive loading due to stress or deformation of the building structure.

When the first modular frame assembly is in the upright position, it is slidingly moved sideways (left or right) and toward the exterior to the desired location between the head and sill liners. The next adjacent modular frame assembly is then tilted into position as described but far enough to the right (or left) of the first assembly to clear the interlocking flanges (133, 130) of the adjacent mullion (104). It is then slidingly moved sideways to its proper position so that mullions 106 and 104 interlock and gaskets 126 and 122 compress. When two or more modular frame assemblies are thus installed, the continuous aluminum wedge strip 92 is then forced into the space between the frame sill leg portion 84 and the sill liner leg portion 50 thereby urging the lower portion of each modular frame assembly down the slanted portion 84 of the sill liner towards the building exterior (to the left in FIG. 2). The glass panel 14 contacts and compresses gasket 52 so as to form the exterior seal at the lower portion of the glass panel. The locking clamp 40 is then driven into and secured to the head liner 22 by positioning the teeth of clamp flange 44 along the teeth of flange 38. The teeth on flange 38 and the clamp flange 44 mate and the clamp teeth ride over the head liner teeth as the clamp is inserted in the head liner (to the left in FIG. 2). Gasket 145 in the lower leg portion 144 of the locking clamp contacts frame head inner leg portion 68, urging the upper portion of the modular frame assembly towards the building exterior. The glass panel contacts and compresses gasket 32 thereby forming the exterior seal at the upper portion the glass panel. The locking clamp teeth drop into engagement with the mating head liner teeth to prevent movement of the clamp to the right in FIG. 2, thereby securing the frame assembly in position while maintaining the seal.

The modular frame assembly of the present invention provides an interior water drainage system which collects condensation and miscellaneous water accumulation within the system and expels it to the exterior. The head liner weep holes 30 (FIG. 2) are spaced along the unit so as to direct water flow within the building structure above to the interior portions of interlocked mullion sections 104, 106. Water flowing down through the mullion sections accumulates inthe channel shaped sill liner 24 which in effect serves as a trough for this water and any water entering between liners and panels. Water in the trough is expelled to the building exterior via weep holes 21 (FIG. 2) which are spaced along the sill liner. Thus, the weep holes 30, 21, the interiors of the interlocked mullion sections 104 and 106, and the trough formed by sill liner 24 constitute a water drainage and/or optional pressure equalization system for the installation.

The modular frame assembly also provides a system which is sealed against air infiltration and exfiltration as well as water penetration by neoprene (or EPDM) compression gaskets 32, 52, 145, aluminum wedge strip 92, sealed in grooves 94 and 96, silicone compatible compound gaskets 122 and 126, and sealed legs 130 and 133 of mullion section 104.

To re-glaze a frame assembly on-site from the building exterior, it is only necessary to remove the damaged glass panel 14 and its silicone bonding beads and then tilt in the new panel and apply new silicone glazing beads from the interior. No exterior caulking is required.

Figure 5:
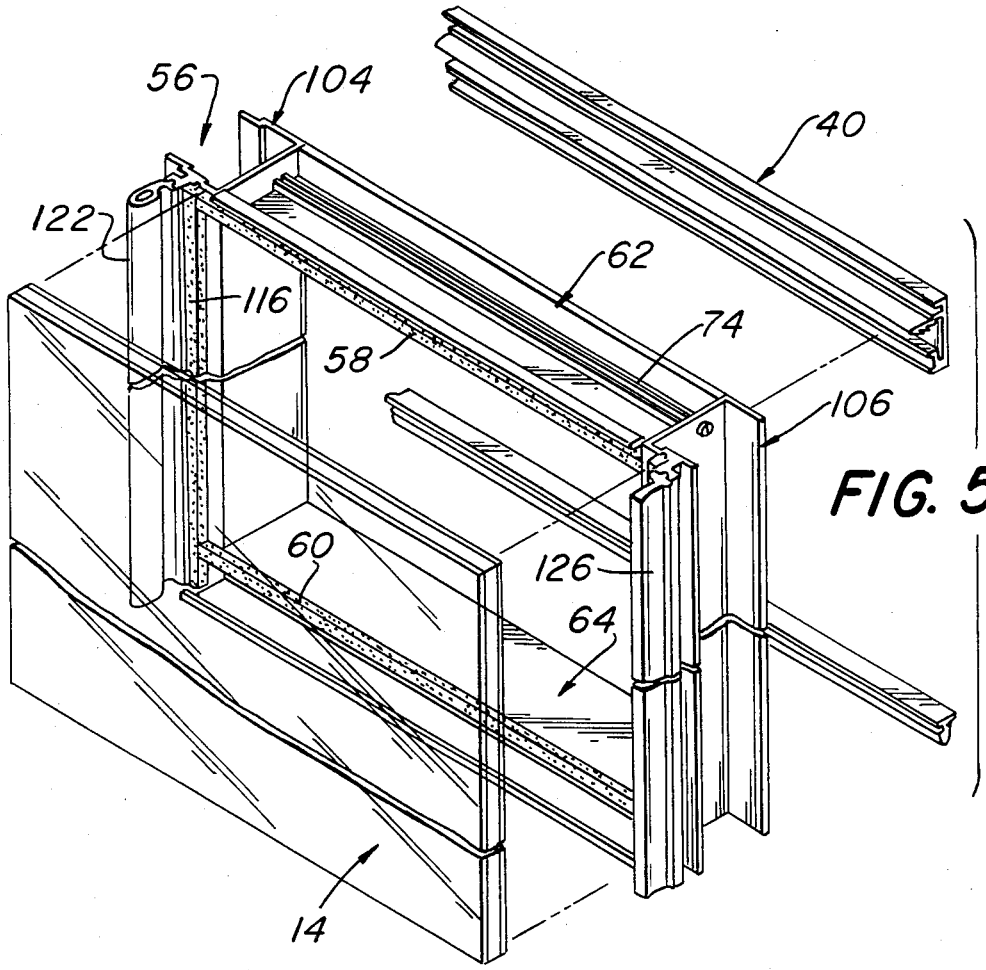
FIG. 5 is an exploded isometric of the modular frame assembly.

As previously indicated, a significant aspect of the present invention is that the modular frame assembly is fabricated and glazed in the shop or factory, that is, off-site. The assembly is then shipped to the field site for immediate installation. FIG. 5 shows the manner in which which the frame assembly is glazed off-site. The modular frame assembly is first formed by fastening the frame head 62 and frame sill 64 to the mullion sections 104, 106 to provide a four sided frame having the desired dimensions as dictated by the panel dimensions. The frame is preferably laid or tilted back on a jig or other supporting structure. Glass panel 14 is then secured to the frame head and sill and the mullion sections using structural silicone beads as previously described. The silicone cures at the factory, so that no time need be allotted for curing, and no clamps need be installed to hold the panels until cure occurs, at the building site. The modular frame assembly is ready to be installed at the field site using the clamp 40 and strip 92 as already described.

Although the invention has been described in terms of a two sided vertical butt glaze system, wherein panel 14 is a glass panel, the system may also be employed to utilize exterior grade and type panels of any suitable material, or to construct room partitions, interior walls and the like using any suitable interior grade panel material. For example, panel 14 may be a granite, spandrel glass, steel or aluminum faced insulated panel, a hard wood panel, a cork panel, or the like secured to a frame head and sill and mullion sections as previously described to form a modular frame assembly insertable between a head liner member and sill liner member located respectively in a building wall, ceiling and floor. Also, the system may be employed to construct, or perform within an entire exterior facade or curtain wall for a building. Thus, panel 14 may be a granite or precast panel secured to an assembled head, sill and mullion frame as described to form a modular frame assembly insertable between head and sill liner members within a building window-wall or curtain-wall system. Other uses include using the same system vertically wherein the panels occur one on top of the other with the gasket sealed joint running horizontally and the liners positioned on each side running vertically. In all cases, modular frame assemblies are positioned and secured in place between the liner members as already described.

For the purpose of illustrating the invention, there is shown in the drawings a form which is presently preferred; it being understood, however, that this invention is not limited to the precise arrangements, dimensions and instrumentalities shown.

I claim:

1. System for butt type installation of panel structures in a building structure comprising:

a head liner and sill liner secured in spaced apart relation to the building structure, prefabricated modular frame assemblies, each insertable as a unit between said head and sill liners and slideable therebetween into side-by-side relation, each modular frame assembly comprising:

(a) a frame head and frame sill extending in parallel, (b) a first mullion section and a second mullion section extending in parallel and secured to opposite ends of said frame head and sill, (c) a panel structure having outer front and back planes, the outer back plane being secured along its perimeter to said frame head and sill and first and second mullion sections, said panel structure having side portions between said outer planes.

(d) said first and second mullion sections being provided with mating structure such that said first mullion section of one modular frame assembly slidingly interlocks with a second mullion section of another modular frame assembly in side-by-side relation therewith, (e) said first and second mullion sections of each modular frame assembly being provided with first and second complementary gaskets respectively, each gasket being disposed along a side portion of the panel structure such that said first complementary gasket of one modular frame assembly contacts the second complementary gasket of another modular frame assembly in side-by-side relation therewith so as to seal the butt joint between the side portions of panel structures of side-by-side modular frame asemblies, and means for securing each said modular frame assembly in sealing relation between said head and sill liners.

2. System for butt type installatin of panel structures according to claim 1 wherein said means for securing said modular frame asembly in sealing relation between said head and sill liners comprises a locking clamp having one end portion adapted to engage said head liner and another end portion spaced from said one end portion so as to contact said modular frame assembly and urge said panel structure outer front plane in sealing relation against a portion of said head liner.

3. System for butt type installation of panels according to claim 1 wherein said sill liner includes an inclined web portion and said means for securing said modular frame assembly in sealing relation between said head and sill liners comprises an elongated wedge member adapted to frictionally fit between said sill liner and said frame sill so as to urge said panel structure outwardly and down the inclined sill liner web portion into sealing relation against another portion of said sill liner.

4. System for butt type installation of panel structure according to claim 1 wherein said frame head is spaced in elevation from said head liner when said modular frame assembly is secured in sealing relation whereby deflection of said head liner does not subject said panel structure to compressive loading.

5. System for butt type installation of panel according to claim 1 wherein said first and second mullion sections are provided with dovetail sockets for receiving said complementary gaskets.

6. System for butt type installation of panels according to claim 2 wherein said head liner and locking clamp are provided with mating structure for slidingly interlocking the head liner and locking clamp.

7. System for butt type installation of panels according to claim 1 wherein said head liner and sill liner are provided with weep holes so as to provide a water drainage channel through said weep holes and said interlocked mullion sections.

8. Butt glaze system for installation of panel structures in a building structure comprising:

a head liner and a sill liner secured in spaced apart relation to the building structure, said sill liner being provided with an apron portion and compression gasket secured thereto, and said head liner being provided with an apron portion and compression gasket secured thereto, prefabricated modular frame assemblies, each insertable as a unit between said head and sill liners and slideable therebetween into side-by-side relation, each modular frame assembly comprising:

(a) a frame head and frame sill extending in parallel, (b) a first mullion section and a second mullion section extending parallel and secured to opposite ends of said frame head and sill, (c) a panel structure having outer front and back planes, the outer back plane being secured along its perimeter to said frame head and sill and first and second mullion sections, the panel structure outer front plane being exposed along its perimeter, said panel structure having side portions between said outer planes, said panel structure being mounted along a side portion on said frame sill, (d) said first and second mullion sections being provided with mating structure such that said first mullion section of one modular frame assembly slidingly interlocks with a second mullion section of another modular frame assembly in side-by-side relation therewith, (e) said first and second mullion sections of each modular frame assembly being provided with first and second complementary gaskets respectively, each gasket being disposed along a side portion of the panel structure such that said first complementary gasket of one modular frame assembly contacts the second complementary gasket of another modular frame assembly in side-by-side relation therewith so as to seal the butt joint between the side portions of panel structures of side-by-side modular frame assemblies, and means for securing each said modular frame assembly in sealing relation between said head and sill liners by urging said panel structure outer front plane against said head liner apron portion and said sill liner apron portion.

9. Butt glaze system according to claim 8 wherein said means for securing said modular frame assembly in sealing relation between said head and sill liners comprises a locking clamp having one end portion adapted to engage said head liner and another end portion spaced from said one end portion so as to contact said modular frame assembly and urge said panel structure outer front plane against said head liner gasket.

10. Butt glaze system according to claim 8 wherein said means for securing said modular frame assembly in sealing relation between said head and sill liners comprises an elongated wedge member adapted to frictionally fit between said sill liner and said frame sill so as to urge said panel structure against said sill linear gasket.

11. Butt glaze system according to claim 8 wherein said frame head is spaced in elevation from said head liner when said modular frame assembly is secured in sealing relation whereby deflection of said head liner does not subject said glass panel structure to compressive loading.

12. Butt glaze system according to claim 8 wherein said first and second mullion sections are provided with dovetail sockets for receiving said complementary gaskets.

13. Butt glaze system according to claim 9 wherein said head liner and locking clamp are provided with mating structure for slidingly interlocking the head liner and locking clamp.

14. Butt glaze system according to claim 8 wherein said head liner and said sill liner are provided with weep holes so as to provide a water drainage channel through said weep holes and said interlocked mullion sections.

15. Butt glaze system for window structure comprising:

a head liner and a sill liner secured in spaced apart relation to the window structure, said head liner having an apron portion provided with a compression gasket, said sill liner having an apron portion provided with a compression gasket, prefabricated modular frame assemblies, each insertable as a unit between said head and sill liners and slideable along said sill liner into side-by-side relation, each modular frame assembly comprising:

(a) a frame head having inner and outer parallel extending leg portions connected by a web section, (b) a frame sill having inner and outer parallel extending leg portions connected by a web section and a shelf portion connected to and extending outwardly from the outer leg portion, (c) a first mullion section secured to like ends of the frame head and frame sill and having inner and outer parallel extending leg portions connected by a web section, (d) a second mullion section secured to like ends of the frame head and frame sill and having inner and outer parallel extending leg portions connected by a web section, (e) said leg portions of said first mullion section being adapted to slidingly interlock with the leg portions of a second mullion section of another modular frame assembly in side-by-side relation therewith.

(f) a panel structure mounted on said frame sill shelf portion and having outer front and back planes, said panel structure outer back plane being secured along its perimeter to each of the outer leg portions of said frame head and sill and first and second mullion sections, said panel structure having side portions between said outer planes, (g) said first and second mullion sections being provided with first and second complementary gaskets respectively, each gasket being disposed along a side portion of the panel structure and extending from the panel structure outer back plane to the panel structure outer front plane such that said first complementary gasket of one modular frame assembly contacts the second complementary gasket of another modular frame assembly in side-by-side relation therewith so as to seal the butt joint between the side portions of panel structures of side-by-side modular frame assemblies from the panel stucture outer back planes to the panel structure outer from planes, means for securing said modular frame assembly in sealing relation between said head and sill liners by urging said panel structure outer front plane against said head liner compression gasket and said sill liner compression gasket.

16. Butt glaze system according to claim 15 wherein said means for securing said modular frame assembly in sealing relation includes an elongated wedge member adapted to frictionally fit between said frame sill and sill liner inner leg portions so as to urge said panel structure outer front plane against said sill liner gasket, and a locking clamp having one end portion adapted to engage said head liner and another end portion spaced from said one end portion so as to contact said modular frame assembly and urge said panel structure outer front plane against said head liner gasket.

17. Butt glaze system according to claim 15 wherein said frame head is spaced in elevation from said head liner when said modular frame assembly is secured in sealing relation whereby deflection of said head liner does not subject said panel structure to compressive loading between said frame head and frame sill.

18. Butt glaze system according to claim 15 wherein said head liner and sill liner are provided with weep holes so as to provide a water drainage channel through said weep holes and said interlocked mullion sections.

19. Butt glaze system according to claim 15 wherein said first and second mullion section outer leg portions are provided with dovetail sockets for receiving said complementary gaskets.

20. Butt glaze system according to claim 16 wherein said head liner and locking clamp are provided with mating structure for slidingly interlocking the head liner and locking clamp.

21. System according to any one of claims 1, 8 and 15 wherein said first mullion section is provided with means for sealingly interlocking with a second mullion section of another modular frame assembly.

22. System according to any one of claims 1, 8 and 15 wherein said complementary gaskets are of different durometers.

23. System according to any one of claims 1, 8 and 15 wherein said panel structure is made of glass.

24. Method of installing panel structures in a building window structure having head and sill liners secured in spaced apart relation thereto comprising:

providing prefabricated modular frame assemblies each having a frame head and frame sill extending in parallel, parallel extending mullion sections and complementary gaskets, each complementary gasket being operatively associated with a mullion section, the mullion sections being secured to opposite ends of the frame head and sill and having interlockable mating structure, and a panel structure having outer front and back planes, the panel structure outer back plane being secured along its perimeter to said frame head and sill and mullion sections, the panel structure having side portions between said outer planes, and each complementary gasket being disposed along a side portion of the panel structure, inserting and sliding said prefabricated modular frame assemblies into side-by-side relation between said head and sill liners such that the mullion section of one modular frame assembly interlocks with the mullion section of another modular frame assembly in side-by-side relation therewith and such that said complementary gaskets associated with side-by-side modular frame assembly mullion sections seal the butt joint between the side portions of panel structures of side-by-side modular frame assemblies, and securing said modular frame assemblies in sealing relation between the head and sill liners.

25. Prefabricated modular frame assembly for installation in a butt glaze window system comprising:

a frame head and frame sill extending in parallel, a first mullion section and a second mullion section extending in parallel, the mullion sections being secured to opposite ends of said frame and sill, a panel structure having outer front and back planes, the outer back plane being secured along its perimter to said frame head and sill and first and second mullion sections, said panel structure having side portions between said outer planes, said panel structure being mounted along a side portion on said frame sill, said first and second mullion sections being provided with mating interlockable structures, each of said first and second mullion sections being provided with a gasket, each gasket extending along a side portion of the panel structure, said gaskets being of a type which deform under compression so as to effect a sealing relation therebetween.

* * * * *